US009775439B2

(12) United States Patent
Rubey

(10) Patent No.: US 9,775,439 B2
(45) Date of Patent: Oct. 3, 2017

(54) BUOYANT POOL FLOAT

(71) Applicant: TRC Recreation, LP, Wichita Falls, TX (US)

(72) Inventor: Ulyss Ray Rubey, Graham, TX (US)

(73) Assignee: TRC Recreation, LP, Wichita Falls, TX (US)

( * ) Notice: Subject to any disclaimer, the term of this patent is extended or adjusted under 35 U.S.C. 154(b) by 0 days.

(21) Appl. No.: 15/413,816

(22) Filed: Jan. 24, 2017

(65) Prior Publication Data

US 2017/0215595 A1 Aug. 3, 2017

Related U.S. Application Data

(60) Provisional application No. 62/288,136, filed on Jan. 28, 2016.

(51) Int. Cl.

| | |
|---|---|
| ***B63B 35/74*** | (2006.01) |
| ***A47C 15/00*** | (2006.01) |
| *A47C 1/14* | (2006.01) |

(52) U.S. Cl.

CPC ..... *A47C 15/006* (2013.01); *A47C 1/143* (2013.01); *B63B 35/74* (2013.01)

(58) Field of Classification Search

CPC ..... A47C 15/006; A47C 1/143; A47C 1/146; B63B 35/74; B63B 35/76; B63B 35/78

USPC ..... D21/803; D6/361

See application file for complete search history.

(56) References Cited

U.S. PATENT DOCUMENTS

| | | | | |
|---|---|---|---|---|
| D169,366 | S | 4/1953 | Feldman | |
| 3,067,441 | A | 12/1962 | Dysard et al. | |
| 3,102,280 | A | 9/1963 | Williams | |
| 3,860,976 | A | 1/1975 | Suyama | |
| 3,984,888 | A | 10/1976 | DeLano | |
| 4,358,866 | A | 11/1982 | Rhodes | |
| 4,564,240 | A | 1/1986 | Thieme | |
| 4,662,852 | A | 5/1987 | Schneider et al. | |
| 4,799,910 | A | 1/1989 | Kellough | |
| 4,986,781 | A | 1/1991 | Smith | |
| 5,004,296 | A | 4/1991 | Ziegenfuss | |
| 5,088,723 | A | 2/1992 | Simmons | |
| 5,090,695 | A * | 2/1992 | Ciolino | A47C 15/006 434/254 |
| 5,403,220 | A | 4/1995 | Goad, Sr. | |
| 5,425,567 | A * | 6/1995 | Albecker, III | A47C 1/146 297/377 |
| 5,439,405 | A | 8/1995 | Storey et al. | |
| 5,722,596 | A * | 3/1998 | Dome | A47C 1/14 239/289 |

(Continued)

*Primary Examiner* — Andrew Polay

(74) *Attorney, Agent, or Firm* — Scott T. Griggs; Griggs Bergen LLP

(57) ABSTRACT

A buoyant pool float for floating in water is disclosed. In one embodiment, the buoyant pool float includes a hingedly connected upper flotation member and lower flotation member. In a deployed position, the buoyant pool float provides an open unfolded engagement between the upper flotation member and the lower flotation member such that a continuous human reclining surface is provided from the upper end of the upper body to the lower end of the lower body. In a storage position, the buoyant pool float provides a closed folded-flat engagement between the upper flotation member and the lower flotation member such that the lower flotation member is nested against the upper flotation member.

10 Claims, 2 Drawing Sheets

(56) References Cited

U.S. PATENT DOCUMENTS

| | | | | |
|---|---|---|---|---|
| 6,045,423 | A | 4/2000 | Silvia | |
| 6,086,150 | A | 7/2000 | Scheurer et al. | |
| 6,126,504 | A | 10/2000 | Day | |
| 6,254,177 | B1 * | 7/2001 | Tseng | A47C 4/10 108/125 |
| 6,312,054 | B1 | 11/2001 | Scheurer et al. | |
| 6,746,293 | B1 | 6/2004 | Kirby et al. | |
| 6,783,181 | B2 | 8/2004 | Scheurer et al. | |
| 6,991,285 | B1 | 1/2006 | Hemenway | |
| 7,571,965 | B1 | 8/2009 | Perry | |
| 9,139,263 | B2 | 9/2015 | Rubey | |
| 9,408,474 | B2 | 8/2016 | Rubey | |
| 9,622,584 | B2 * | 4/2017 | Eicke | A47C 7/02 |

* cited by examiner

BUOYANT POOL FLOAT

This application claims priority from U.S. Patent Application Ser. No. 62/288,136, entitled "Buoyant Pool Float" and filed on Jan. 28, 2016, in the name of Ulyss Ray Rubey; which is hereby incorporated by reference for all purposes.

TECHNICAL FIELD OF THE INVENTION

This invention relates, in general, to swimming pool recreational accessories and, more particularly, to a buoyant pool float for supporting a person in a sitting or reclining position, for example, while the buoyant pool float is floating in the water.

BACKGROUND OF THE INVENTION

Swimming pools offer recreation and relaxation in a variety of settings, including private homes, apartment complexes, motels, resorts, and country clubs. Various flotation devices, including buoyant chairs, rafts, water wings, floating cushions, body floats and air mattresses are used by swimmers as an aid for floating and relaxing on the surface of the water, while remaining in a seated or reclining position, with varying degrees of submergence. These items of pool furniture include flotation cushions made of a buoyant material such as open cell foam, closed cell foam, cork, kapok, fiberglass or balsa wood, which are sealed within a protective outer coating. Special care should be taken in the construction of buoyant lounge chairs to provide sufficient buoyance material to maintain a stable upright orientation, while the occupant is in a semi- or fully-reclining orientation. As can be appreciated, the buoyant pool float may overturn in response to shifting of its center of buoyancy as the occupant turns or moves about and, as a result, there is a continuing need for improved design.

SUMMARY OF THE INVENTION

It would be advantageous to achieve a buoyant pool float serving as a swimming pool recreational accessory for a swimmer in an upright, semi-reclining, sitting, or reclining position, for example, that would improve upon existing limitations in stability and functionality. It would also be desirable to enable a mechanical solution that would mitigate or eliminate the chances of the buoyant pool lounge chair being overturned in response to shifting of its center or buoyancy. Further, it would be desirable to enable a mechanical solution that provides a buoyant pool lounge chair while providing improved value engineering and construction. To better address one or more of these concerns, a buoyant pool float is disclosed.

In one embodiment, the buoyant pool float includes a hingedly connected upper flotation member and lower flotation member. In a deployed position, the buoyant pool float provides an open unfolded engagement between the upper flotation member and the lower flotation member such that a continuous human reclining surface is provided from the upper end of the upper body to the lower end of the lower body. In a storage position, the buoyant pool float provides a closed folded-flat engagement between the upper flotation member and the lower flotation member such that the lower flotation member is nested against the upper flotation member. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
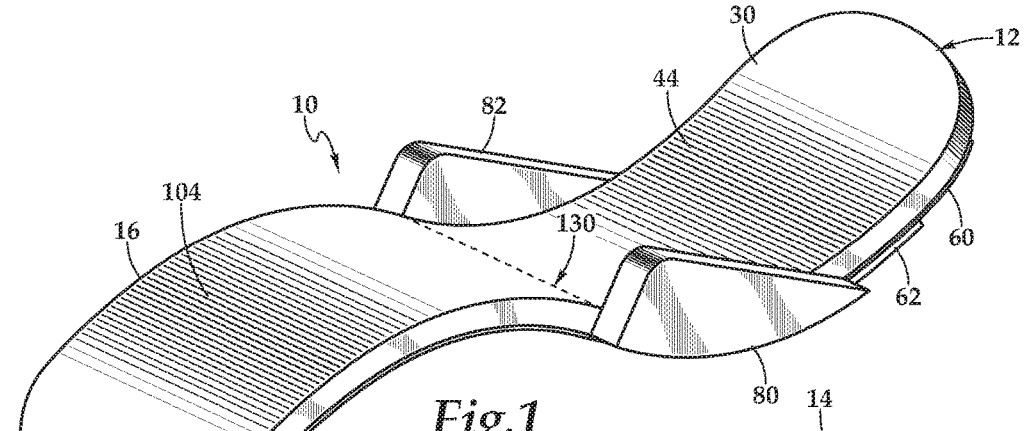
FIG. 1 is a front top perspective view of one embodiment of a buoyant pool float in a deployed position according to the teachings presented herein that is floating in water.
Figure 2:
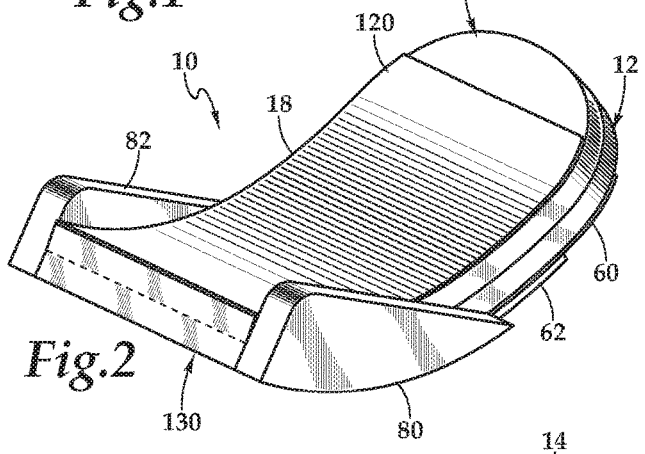
FIG. 2 is a front bottom perspective view of the buoyant pool float depicted in FIG. 1 in a storage position.
Figure 3:
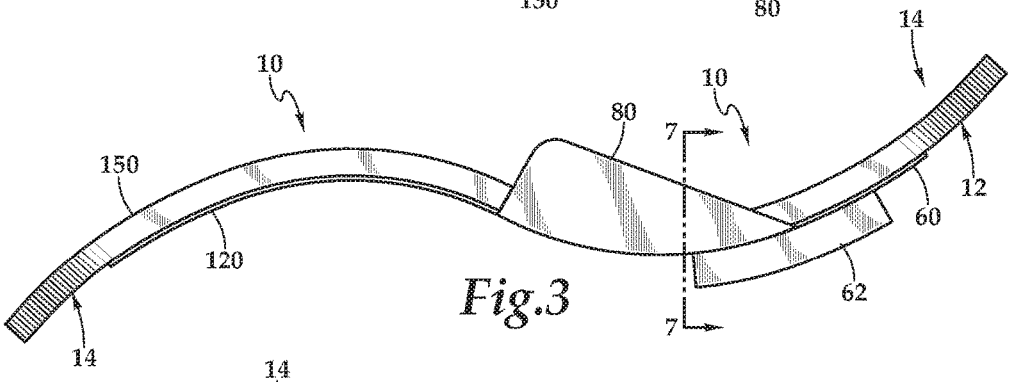
FIG. 3 is a side elevation view of the buoyant pool float depicted in FIG. 1 in an extended position.
Figure 4:
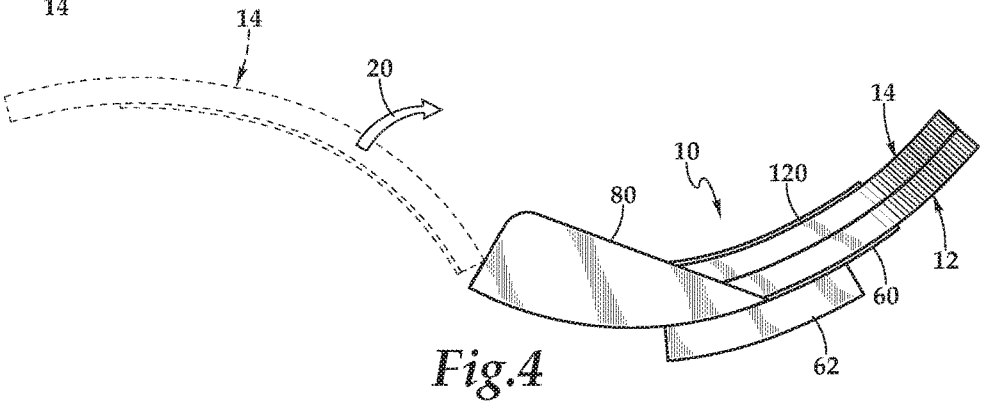
FIG. 4 is a side elevation view of the buoyant pool float depicted in FIG. 1 in a folded position.
Figure 5:
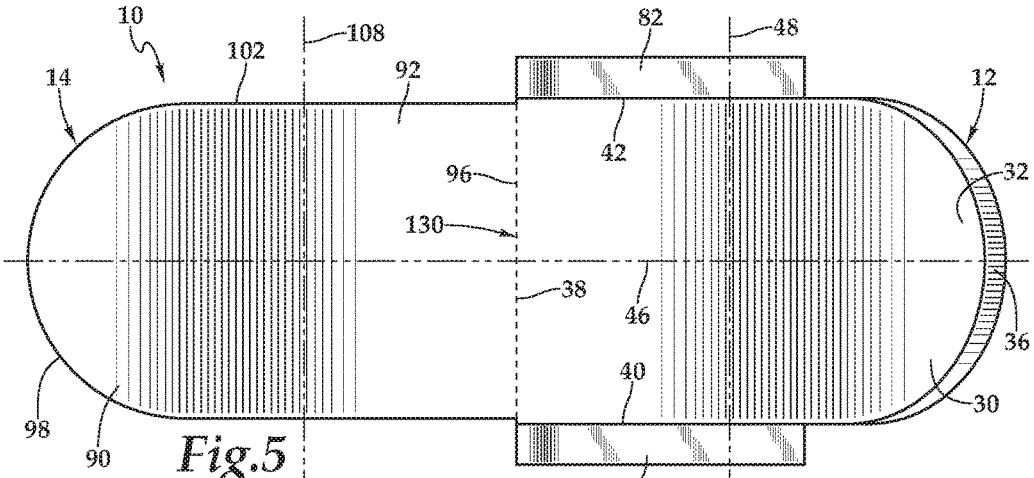
FIG. 5 is a top plan view of the buoyant pool float depicted in FIG. 1.
Figure 6:
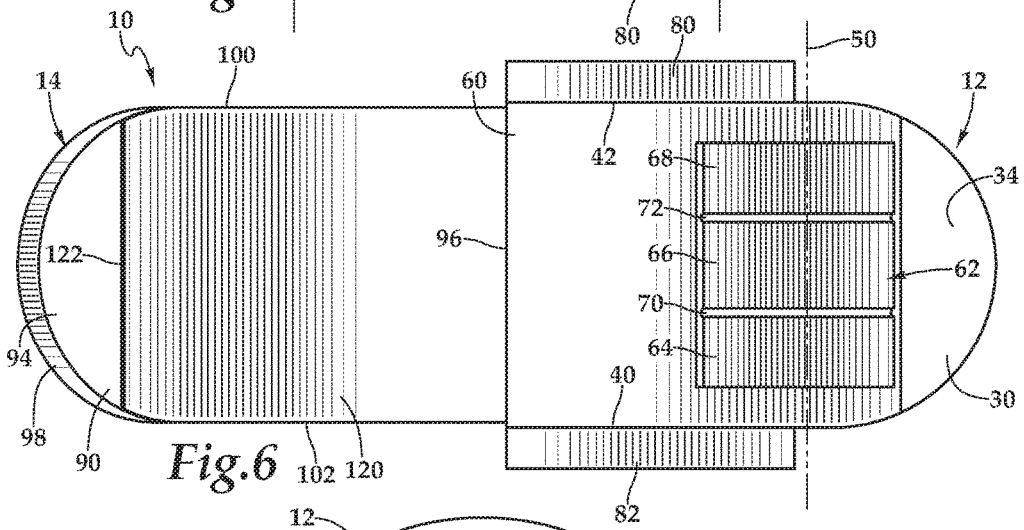
FIG. 6 is a bottom plan view of the buoyant pool float depicted in FIG. 1.
Figure 7:
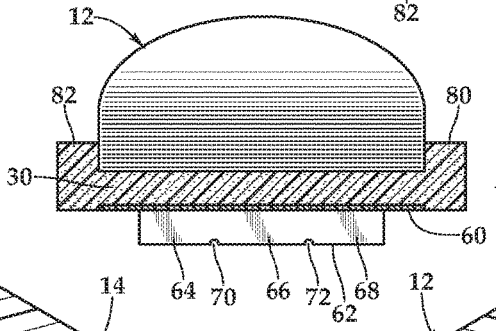
FIG. 7 is a cross-sectional view of the buoyant pool float depicted in figure as viewed along line 7-7 of FIG. 3.

Referring now to FIG. 1 through FIG. 7, therein is depicted one embodiment of a buoyant pool float 10, which is schematically illustrated and designed. As shown, the buoyant pool float 10 floats on water and includes an upper flotation member 12 and a lower flotation member 14, which are hingedly connected to provide the deployed position 16 and the storage position 18. By way of illustration, the deployed position 16 is converted to the storage position 18 by, in one embodiment, folding the lower flotation member 14 into the upper flotation member 12 as shown by arrow 20.

The upper flotation member 12 includes an upper body 30 having a top 32, a bottom 34, an upper end 36, a lower end 38, a left side 40, and a right side 42. The upper body 30 is generally rectangular in plan with the upper end 36 of the upper body 30 being rounded. As illustrated, the upper body 30 may be concave in curvature when the upper flotation member 12 is deployed in the deployed position 16 and the storage position 18. Further, as shown, the upper body 30 includes a longitudinal axis 46 and an upper transverse axis 48.

The upper flotation member 12 also includes an upper centra 60 secured to the bottom of the upper body 30 substantially traversing the longitudinal axis 46 from the lower end 38 of the upper body 30 to a midpoint 50 between the upper transverse axis 48 and the upper end 36. A flotation member 62 is secured to the bottom 34 of the upper body 30 subjacent to the upper centra 60 and extending vertically and horizontally thereform while traversing the longitudinal axis 46 from the lower end 38 of the upper body 30 to proximate the upper transverse axis 48. The flotation member 62, which includes flotation submembers 64, 66, 68, is configured to provide passive stability to the buoyant pool float 10 by increasing hydrodynamic resistance to rolling when the buoyant pool float 10 is deployed in a reclining position. As shown, grooves 70, 72 separate the flotation submembers 64, 66, 68 with the groove 70 being positioned between flotation submembers 64, 66 and the groove 72 being positioned between flotation submembers 66, 68. In one embodiment, the flotation submembers 64, 66, 68 are integral and may span the gaps therebetween.

Continuing to refer to FIG. 1 through FIG. 7, a left arm 80 and a right arm 82 are respectively secured to the left and right sides 40, 42 of the upper body 30. In one embodiment, each of the left and right arms 80, 82 conform to the curvature of the upper body 30 and intersect the lower end 38 of the upper body 30. The left and right arms 80, 82 provide comfortable arm rests plus the important function of side-to-side stability to prevent the chair from rolling sideways and dumping the user in the water. As illustrated, the upper end 36 of the upper body 30 includes a size to accommodate a human head and torso of an individual using the buoyant pool float 10. Further, the upper centra 60 includes a hardness greater than the upper body 30 to provide a stable rigid support structure to the upper floatation member 12.

The lower flotation member 14 includes a lower body 90 having a top 92, a bottom 94, an upper end 96, a lower end 98, a left side 100, and a right side 102. The lower body 90 is generally rectangular in plan with the lower end 98 of the lower body 90 being rounded. The lower body may be concave in curvature 104 when the buoyant pool float 10 is deployed in a storage position 18 and convex in curvature 104 when the buoyant pool float 10 is deployed in a deployed position providing for reclining. As shown, the lower body 90 shares the longitudinal axis 46 and also includes a lower transverse axis 108. The lower end 98 of the lower body includes a size to accommodate human legs and feet of an individual using the buoyant pool float 10.

The lower flotation member 14 includes a lower centra 120 secured to the bottom 94 of the lower body 90 and substantially traversing the longitudinal axis 46 from the upper end 96 of the lower body 90 to a midpoint 122 between the lower transverse axis 108 and the lower end 98. The lower centra 120, similar to the upper centra 60, may include a hardness greater than the lower body 90 to provide a stable rigid support structure to the lower floatation member 14. In one embodiment, the upper centra 60 and the lower centra 120 may be substantially identical in size and shape.

Figure 8:
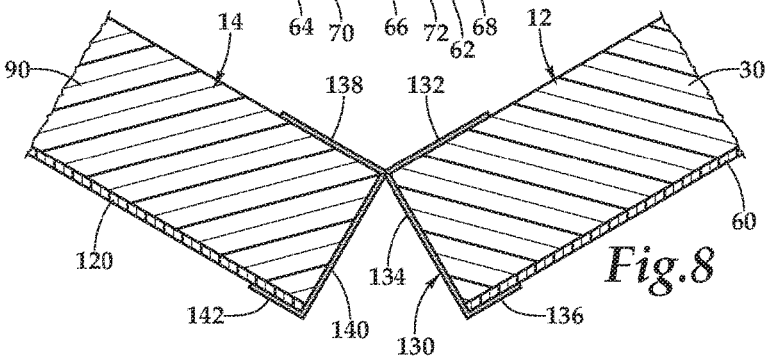
FIG. 8 is a cross-sectional view of a hinged joint of the buoyant pool float depicted in FIG. 1.

Referring to FIG. 1 through FIG. 4 and FIG. 8, a continuous hinge 130 hingedly couples the lower end 38 of the upper flotation member 12 to the upper end 96 of the lower flotation member 14. The continuous hinge 130 is configured to provide a mechanically bearing furnishing rotation between the deployed position 16 and the storage position 18. The deployed position 16 provides an open unfolded engagement between the upper flotation member 12 and the lower flotation member 14 such that a continuous human reclining surface is provided from the upper end of the upper body to the lower end of the lower body.

On other hand, the storage position 18 provides open engagement between the upper flotation member 12 and the lower flotation member 14 such that the lower flotation member 14 is nested against the upper flotation member 12. As shown, in one embodiment, the continuous hinge includes hinge submembers 132, 134, and 136 that respectively contact the top 32, the lower end 38, and the bottom 34 of the upper body 30. Similarly, hinge submembers 138, 140, and 142 respectively contact the top 92, the upper end 96 and the bottom 94 of the lower body 90. In one embodiment, the continuous hinge 130 may include an adhesive reinforced vinyl fabric hinge.

As constructed, in one embodiment, the buoyant pool float 10 may be designed as two continuous forms of a pliable foam material of constant or appropriately varying density that varies in thickness with a coating applied thereon to provide the upper flotation member 12 and the lower flotation member 14. The construction may include closed cell PVC foam. The construction may include molded foam being provided by a single or multiple molding process, and, in one embodiment, may include void spaces of select shapes to accommodate cup holders or the like. In one embodiment, the construction includes slabs of closed cell polyurethane foam, such as closed cell polyurethane foam, having a density in the range of approximately 1 lbs/ft$^3$ (16 kg/m$^3$) to approximately 6 lbs/ft$^3$ (96 kg/m$^3$). Further, by way of example, the upper flotation member 12 and the lower flotation member 14 may be made by a partially or fully blow molded process depending on volumes.

In one embodiment, the upper centra 60 and lower centra 120 may be constructed of polyvinyl chloride (PVC) material. In the instance of the upper centra 60 and lower centra 120, the PVC material may comprise a rigid PVC foam board or, more particularly, a lightweight yet rigid board of moderately expanded closed-cell PVC extruded in a homogeneous sheet with a low gloss matte finish. Such a closed-cell PVC is sold under the brand name SINTRA. In another embodiment, multiple closed-cell PVC boards may be used sandwiched between foam slabs to increase the rigidity of components such as the left arm 80 and right arm 82. A protective coating 150, which is water proof, may be applied by various processes, including dipping and spraying, for example. In implementations where the entire or substantially entire buoyant pool float 10 is waterproof, a protective coating 150 is not needed. A protective coating 150, such as a vinyl coating, provides an attractive smooth surface for appearance and comfort in addition to increased wear resistance and resistant to the elements such as UV radiation. Further, the upper body 30 and the lower body 90 may be made by a partially or fully blow molded process depending on volumes. It should be appreciated that although a particular construction and materials are presented herein, the construction of the buoyant pool float 10 presented herein may vary according to the particular application and other constructions and choices of materials are within the teachings presented herein.

By way of example and not by way of limitation, the buoyant pool float 10 may be constructed such that the length along the longitudinal axis 46 is over about 6.5 feet (1.98 m) from the upper end 36 of the upper flotation member 12 to the lower end 38 of the lower flotation member 14. The width of the buoyant pool float 10 may be about 24 inches (609.6 mm) in between the left arm 80 to the right arm 82 across the upper transverse axis 38. The width of the buoyant pool float 10 may be about 23 inches (584.2 mm) across the lower transverse axis 108. That is, in one implementation, the lower flotation member 14 is narrower than the upper flotation member 12 such that a friction fit between the lower flotation member 14 and the left and right arms 80, 82 occurs when the buoyant pool float 10 is in the storage position 18. It should be appreciated that although a particular construction and materials are presented herein, the construction of the buoyant pool float 10 presented herein may vary according to the particular application and other constructions and choices of materials are within the teachings presented herein.

As previously alluded, special care should be taken in the consideration of buoyant lounge chairs to provide sufficient buoyancy material to maintain a stable upright orientation while the occupant is in a semi-reclining, seated, or reclining orientation, for example. Such special care is warranted as any buoyant lounge chair or buoyant pool float can overturn in response to shifting of its center of buoyancy as the occupant turns or moves about. In one embodiment of the buoyant pool float 10, buoyancy sufficient to support an adult occupant having a body weight of 250 lbs (113 kg) is provided by the construction. In particular, buoyance may be achieved through the two-piece construction including the upper flotation member 12 and the lower flotation member 14 having the respective upper centra 60 and lower centra 120.

The order of execution or performance of the methods and manufacturing operations illustrated and described herein is not essential, unless otherwise specified. That is, elements of the methods and manufacturing operations may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A buoyant pool float for floating in water, the buoyant pool float comprising:

an upper flotation member including an upper body having a top, a bottom, an upper end, a lower end, a left side, and a right side, the upper body being generally rectangular in plan with the upper end of the upper body being rounded, the upper body being concave in curvature when the upper flotation member is deployed in a stored position and a reclining position, the upper body having a longitudinal axis and an upper transverse axis;

the upper flotation member including an upper centra secured to the bottom of the upper body substantially traversing the longitudinal axis from the lower end of the upper body to a midpoint between the upper transverse axis and the upper end;

the upper flotation member including a flotation member secured to the bottom of the upper body subjacent to the upper centra and extending vertically and horizontally thereform while traversing the longitudinal axis from the lower end of the upper body to proximate the upper transverse axis;

the upper flotation member including left and right arms respectively secured to the left and right sides of the upper body, each of the left and right arms conforming to the curvature of the upper body and intersecting the lower end of the upper body;

a lower flotation member including a lower body having a top, a bottom, an upper end, a lower end, a left side, and a right side, the lower body being generally rectangular in plan with the lower end of the lower body being rounded, the lower body being concave in curvature when the buoyant pool float is deployed in a stored position and convex when the buoyant pool float is deployed in a reclining position, the lower body sharing the longitudinal axis and including a lower transverse axis;

the lower flotation member including a lower centra secured to the bottom of the lower body substantially traversing the longitudinal axis from the upper end of the lower body to a midpoint between the lower transverse axis and the lower end;

a continuous hinge hingedly coupling the lower end of the upper flotation member to the upper end of the lower flotation member, the continuous hinge configured to provide a mechanically bearing furnishing rotation between the deployed position and the storage position;

the deployed position providing open unfolded engagement between the upper flotation member and the lower flotation member such that a continuous human reclining surface is provided from the upper end of the upper body to the lower end of the lower body; and the storage position providing closed folded between the upper flotation member and the lower flotation member such that the lower flotation member is nested against the upper flotation member.

2. The buoyant pool float as recited in claim 1, wherein the upper centra comprises a hardness greater than the upper body.

3. The buoyant pool float as recited in claim 1, wherein the lower centra comprises a hardness greater than the lower body.

4. The buoyant pool float as recited in claim 1, wherein the upper centra further comprises a stable rigid support structure.

5. The buoyant pool float as recited in claim 1, wherein the lower centra further comprises a stable rigid support structure.

6. The buoyant pool float as recited in claim 1, wherein the upper end of the upper body further comprises a size to accommodate a human head and torso of an individual using the buoyant pool float.

7. The buoyant pool float as recited in claim 1, wherein the lower end of the lower body further comprises a size to accommodate human legs and feet of an individual using the buoyant pool float.

8. The buoyant pool float as recited in claim 1, wherein the continuous hinge further comprises an adhesive reinforced vinyl fabric hinge.

9. A buoyant pool float for floating in water, the buoyant pool float comprising:

an upper flotation member including an upper body having a top, a bottom, an upper end, a lower end, a left side, and a right side, the upper body being generally rectangular in plan with the upper end of the upper body being rounded, the upper body being concave in curvature when the upper flotation member is deployed in a stored position and a reclining position, the upper body having a longitudinal axis and an upper transverse axis;

the upper flotation member including an upper centra secured to the bottom of the upper body substantially traversing the longitudinal axis from the lower end of the upper body to a midpoint between the upper transverse axis and the upper end;

the upper flotation member including a flotation member secured to the bottom of the upper body subjacent to the upper centra and extending vertically and horizontally thereform while traversing the longitudinal axis from the lower end of the upper body to proximate the upper transverse axis;

the upper flotation member including left and right arms respectively secured to the left and right sides of the upper body, each of the left and right arms conforming to the curvature of the upper body and intersecting the lower end of the upper body;

the upper centra including a hardness greater than the upper body to provide a stable rigid support structure to the upper floatation member;

a lower flotation member including a lower body having a top, a bottom, an upper end, a lower end, a left side, and a right side, the lower body being generally rectangular in plan with the lower end of the lower body being rounded, the lower body being concave in curvature when the buoyant pool float is deployed in a stored position and convex when the buoyant pool float is deployed in a reclining position, the lower body sharing the longitudinal axis and including a lower transverse axis;

the lower flotation member including a lower centra secured to the bottom of the lower body substantially traversing the longitudinal axis from the upper end of the lower body to a midpoint between the lower transverse axis and the lower end;

the lower centra including a hardness greater than the lower body to provide a stable rigid support structure to the lower floatation member;

a continuous hinge hingedly coupling the lower end of the upper flotation member to the upper end of the lower flotation member, the continuous hinge configured to provide a mechanically bearing furnishing rotation between the deployed position and the storage position;

the deployed position providing open unfolded engagement between the upper flotation member and the lower flotation member such that a continuous human reclining surface is provided from the upper end of the upper body to the lower end of the lower body;

the storage position providing closed folded between the upper flotation member and the lower flotation member such that the lower flotation member is nested against the upper flotation member; and the lower flotation member being narrower than the upper flotation member such that a friction fit is formed between the lower flotation member and the left and right arms when the buoyant pool float is in the storage position.

10. A buoyant pool float for floating in water, the buoyant pool float comprising:

an upper flotation member including an upper body having a top, a bottom, an upper end, a lower end, a left side, and a right side, the upper body being generally rectangular in plan with the upper end of the upper body being rounded, the upper body being concave in curvature when the upper flotation member is deployed in a stored position and a reclining position, the upper body having a longitudinal axis and an upper transverse axis;

the upper flotation member including an upper centra secured to the bottom of the upper body substantially traversing the longitudinal axis from the lower end of the upper body to a midpoint between the upper transverse axis and the upper end;

the upper flotation member including a flotation member secured to the bottom of the upper body subjacent to the upper centra and extending vertically and horizontally thereform while traversing the longitudinal axis from the lower end of the upper body to proximate the upper transverse axis;

the upper flotation member including left and right arms respectively secured to the left and right sides of the upper body, each of the left and right arms conforming to the curvature of the upper body and intersecting the lower end of the upper body;

the upper end of the upper body comprising a size to accommodate a human head and torso of an individual using the buoyant pool float;

the upper centra including a hardness greater than the upper body to provide a stable rigid support structure to the upper floatation member;

a lower flotation member including a lower body having a top, a bottom, an upper end, a lower end, a left side, and a right side, the lower body being generally rectangular in plan with the lower end of the lower body being rounded, the lower body being concave in curvature when the buoyant pool float is deployed in a stored position and convex when the buoyant pool float is deployed in a reclining position, the lower body sharing the longitudinal axis and including a lower transverse axis;

the lower end of the lower body comprising a size to accommodate human legs and feet of an individual using the buoyant pool float;

the lower flotation member including a lower centra secured to the bottom of the lower body substantially traversing the longitudinal axis from the upper end of the lower body to a midpoint between the lower transverse axis and the lower end;

the lower centra including a hardness greater than the lower body to provide a stable rigid support structure to the lower floatation member;

a continuous hinge hingedly coupling the lower end of the upper flotation member to the upper end of the lower flotation member, the continuous hinge configured to provide a mechanically bearing furnishing rotation between the deployed position and the storage position;

the continuous hinge being an adhesive reinforced vinyl fabric hinge;

the deployed position providing open unfolded engagement between the upper flotation member and the lower flotation member such that a continuous human reclining surface is provided from the upper end of the upper body to the lower end of the lower body;

the storage position providing closed folded engagement between the upper flotation member and the lower flotation member such that the lower flotation member is nested against the upper flotation member; and the lower flotation member being narrower than the upper flotation member such that a friction fit is formed between the lower flotation member and the left and right arms when the buoyant pool float is in the storage position.

* * * * *